US006217502B1

(12) United States Patent
Hällgren et al.

(10) Patent No.: US 6,217,502 B1
(45) Date of Patent: Apr. 17, 2001

(54) CENTRIFUGAL SEPARATOR HAVING A LIQUID FILLED TRANSMISSION CHAMBER

(75) Inventors: Ingvar Hällgren, Tumba; Hans Martin, Skärholmen; Berndt Nyström, Bandhagen, all of (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/402,191

(22) PCT Filed: Mar. 26, 1999

(86) PCT No.: PCT/SE98/00551

§ 371 Date: Dec. 29, 1999

§ 102(e) Date: Dec. 29, 1999

(87) PCT Pub. No.: WO98/45048

PCT Pub. Date: Oct. 15, 1998

(30) Foreign Application Priority Data

Apr. 4, 1997 (SE) ..... 9701226

(51) Int. Cl.[7] ..... B04B 1/00

(52) U.S. Cl. ..... 494/27; 494/50; 494/51; 494/53

(58) Field of Search ..... 494/27, 50, 51, 494/52, 53, 54

(56) References Cited

U.S. PATENT DOCUMENTS 3,685,721 * 8/1972 Kohama .

OTHER PUBLICATIONS

International Search Report, PCT/SE98/00551, Jul. 7, 1998.*

* cited by examiner

*Primary Examiner*—David A. Reifsnyder
(74) *Attorney, Agent, or Firm*—Fish & Richardon P.C.

(57) ABSTRACT

In a centrifugal rotor (2) for freeing a liquid from solid particles suspended therein and being heavier than the liquid there is delimited a separation chamber (20), in which one or more conveyor screws (29) are arranged to supply separated particles axially along a surrounding wall (17) of the rotor. Each conveyor screw (29) is connected with a drivable bearing member (31) through a transmission shaft (38) extending out through one end wall (13) of the rotor. This bearing member (31) is journalled in the centrifugal rotor (2) and is situated in a transmission chamber (47) formed between said end wall (13) and a further wall (46). The transmission chamber (47) contains a liquid during operation of the centrifugal rotor, which liquid lubricates the bearing surfaces (43, 44) of the bearing members (31) and the centrifugal rotor and also influences the bearing members (31) by a hydraulic force directed towards the rotational axis of the centrifugal rotor, so that the loading of the bearing members on said bearing surfaces (43, 44) is reduced.

14 Claims, 9 Drawing Sheets

CENTRIFUGAL SEPARATOR HAVING A LIQUID FILLED TRANSMISSION CHAMBER

FIELD OF THE INVENTION

The present invention relates to a centrifugal separator for freeing a liquid from solids particles suspended therein and having a density larger than that of the liquid. The centrifugal separator comprises a rotor having a centre axis, around which it is rotatable, and comprising two axially separated end walls and a surrounding wall situated therebetween, said walls surrounding a separation chamber, at least one conveyor screw device which is arranged in the separation chamber and is rotatable relative to the rotor for axial transportation of separated solid particles along the surrounding wall, two or more transmission shafts for the operation of the conveyor screw device, which extend from the separation chamber through respective openings in one of said end walls and are rotatable around rotational axes substantially parallel with the centre axis of the rotor, and bearings for radial journalling of the transmission shafts in the rotor.

BACKGROUND OF THE INVENTION

A centrifugal separator of this kind is shown and described in U.S. Pat. No. 3,685,721. Within the rotor of this known centrifugal separator four conveyor screws are arranged. Each one of these has or is connected with a transmission shaft of the above mentioned kind, which extends out through one of the rotor end walls.

If the rotor in a centrifugal separator of this kind is to be caused to rotate at a very high rotational speed for accomplishing high separation efficiency, rotation of the conveyor screws relative to the rotor will encounter a large resistance, and the bearings through which the transmission shafts are journalled in the rotor will be strongly loaded, especially because the conveyor screws as well as their transmission shafts have to rotate at a high speed in a path at a large distance from the rotational axis of the rotor. A problem in this connection is to maintain in said bearings, which in their entirety rotate around the rotational axis of the rotor, the necessary amount of lubricant during a long time of operation for the rotor.

The object of the present invention is to provide an arrangement which is as advantageous as possible as to the operation conditions for the said bearings, as a consequence of the fact that these together with the transmission shafts rotate during operation of the rotor around the rotational axis of the rotor.

According to the invention this object may be achieved in a centrifugal separator of the initially defined kind in a way such that the rotor delimits a transmission chamber that is liquid tightly separated from the separation chamber and that the rotor is formed to maintain in the transmission chamber during rotation of the rotor an auxiliary liquid in contact with at least part of each one of said bearings.

In this way the said bearings, which are preferably constituted by slide bearings, may be constantly lubricated by said auxiliary liquid. This may preferably be constituted by water. The transmission chamber, which preferably is annular and is delimited between said one end wall and a further wall extending around the rotational axis of the rotor, may have an overflow outlet for said auxiliary liquid.

In an advantageous embodiment of the invention each transmission shaft supports a bearing member in the transmission chamber, which has a bearing surface extending around the transmission shaft along a circle having a substantially larger diameter than that of said openings in the rotor end wall, through which the transmission shaft extends. Hereby, the pressure per unit of surface in each bearing will become somewhat reduced. Furthermore, a relatively large part of each bearing member will be immersed in auxiliary liquid in the transmission chamber and, thereby, be acutated during rotation of the rotor by a hydraulic force directed towards the rotational axis of the rotor. This force results in a certain unloading of the bearing.

Preferably, said bearing members are used also for transmission of rotational movement from a central transmission member in the rotor to said transmission shafts. Then, it is desirable that the transmission forces being transferred are acting as close to the bearings of the transmission shafts as possible. According to the invention each bearing member, therefore, has a surrounding part, which has an inside with a bearing surface facing the transmission shaft and also an outside through which it engages with the central transmission member. This engagement may be direct, e.g. through cogs, or indirect, e.g. through a tooth belt. In both cases the said surrounding part should be in a driving engagement with the central transmission member in an axial plane that substantially coincides with an axial plane through said bearing surface of the surrounding part.

BRIEF DESCRIPTION OF THE DRAWINGS

The invention is described in the following with reference to the accompanying drawing, in which.

DETAILED DESCRIPTION

Figure 1:
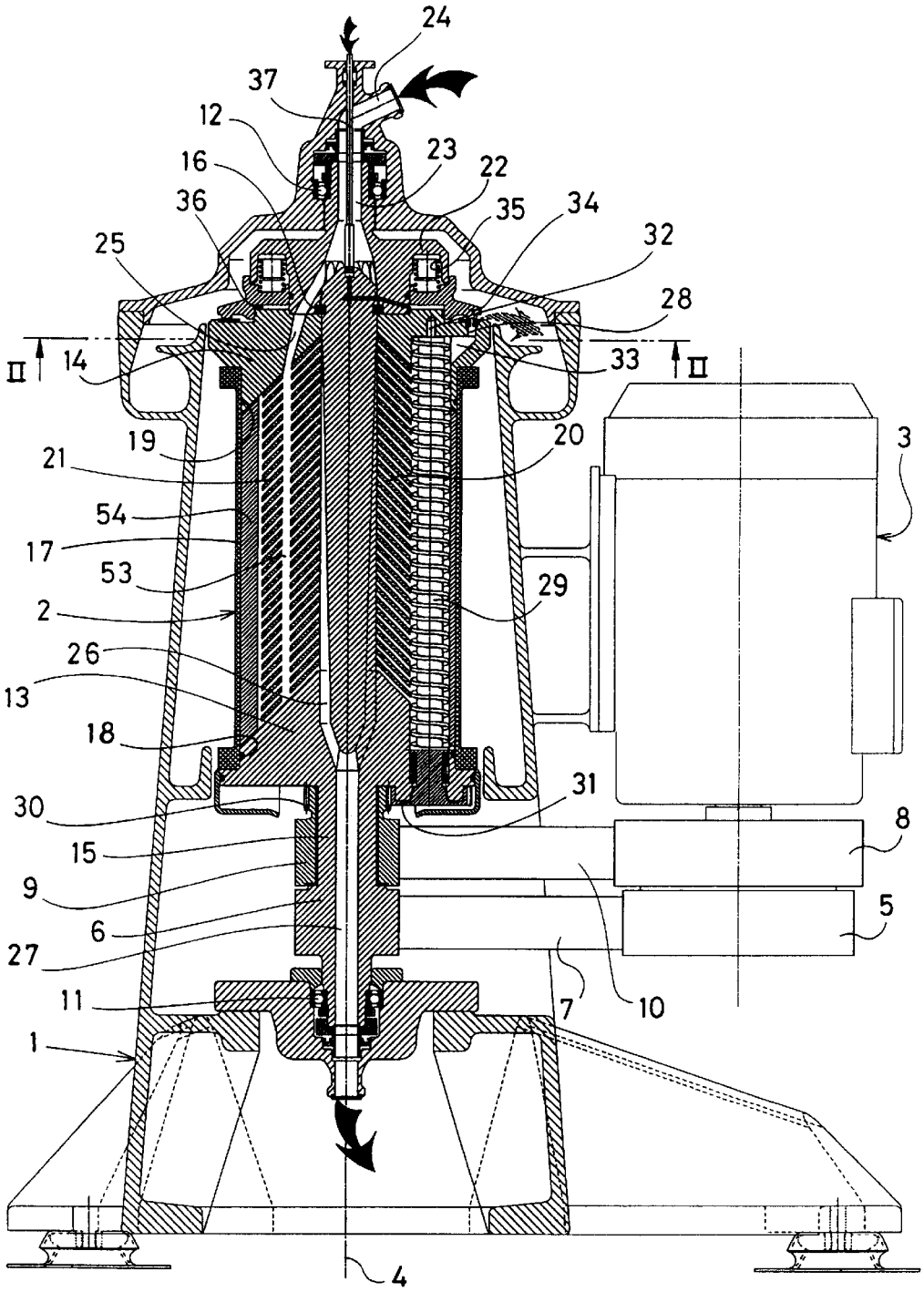
FIG. 1 shows in a longitudinal section a centrifugal separator according to a preferred embodiment of the invention.

FIG. 1 shows a centrifugal separator for freeing a liquid from solid particles suspended therein and having a density larger than that of the liquid. The centrifugal separator comprises a frame 1, a rotor 2 that is rotatably supported by and within the frame 1 and a motor 3 that is also supported by the frame but on its outside and that is adapted for rotation of the rotor 2 about a vertical rotational axis 4 coinciding with the centre axis of the rotor. For this purpose the motor 3 supports on its drive shaft a belt pulley 5 and the rotor supports at its lower part a belt pulley 6. A drive belt 7 surrounds both the belt pulleys 5 and 6.

The motor 3 supports on its drive shaft a further belt pulley 8, which together with an annular transmission member 9 arranged coaxially with the rotor 2 and rotatable relative thereto is surrounded by a further drive belt 10.

The rotor 2, which is rotatably suspended in the frame by means of a lower bearing 11 and an upper bearing 12, comprises a lower end wall 13 and an upper end wall 14. The lower end wall 13 is formed in one piece with a shaft 15 that extends all the way from the area of the lower bearing 11 past the lower end wall 13 up to the upper end wall 14 and through a central opening therein. By means of a locking member 16 the upper end wall 14 is fixed relative to the shaft 15 at least in a way such that it cannot move in a direction away from the lower end wall 13. By means not shown the end wall 14 is also fixed relative to the shaft 15 in its circumferential direction. The rotor further comprises a circular-cylindrical surrounding wall 17, which extends axially between the end walls 13 and 14, coaxially surrounding the shaft 15 spaced therefrom. The surrounding wall 17 shall not transfer any substantial axial force and, therefore, is not firmly connected with the end walls 13 and 14. Instead, the surrounding wall 17 abuts at its ends through annular gaskets 18 and 19 radially against the respective end walls 13 and 14. However, the surrounding wall 17 is formed such that it can take up very large forces in its circumferential direction and, therefore, is reinforced by carbon or glass fibres extending substantially in said circumferential direction.

The end walls 13, 14 and the surrounding wall 17 surrounds a separation chamber 20 within the rotor. The separation chamber 20 surrounds the shaft 15 and has an axial extension substantially larger than its radial extension.

Within the separation chamber 20 coaxially with the rotor a stack of frustoconical separation discs 21 is arranged between the end walls 13, 14. By means of spacing members the separation discs are maintained at some axial distance from each other.

The upper end wall 14 on its outside is connected with an inlet member 22 forming a central, vertical inlet channel 23. This inlet channel 23 communicates at its upper end with an inlet 24 for liquid to be treated within the rotor, and it branches off at its lower end in several branch channels 25. The branch channels 25 which are formed partly in the inlet member 22 and partly in the upper end wall 14 open into the upper part of the separation chamber 20 radially about half-way between the central rotor shaft 15 and the surrounding wall 17.

The lower end wall 13 has a number of branch channels 26 intended for liquid having been treated in the rotor. The branch channels 26 start from the lower part of the separation chamber 20 and extend to a common outlet channel 27 which in its turn extends further centrally in the rotor shaft 15 to and out through the lower end thereof.

For solid particles having been separated from said liquid in the separation chamber 20 the rotor has several outlet channels 28 extending from the uppermost part of the separation chamber axially through the upper end wall 14 at the radially outermost portion thereof. For transportation of particles separated in the separation chamber 20 to the outlet channels 28 the rotor comprises a conveyor screw device including several conveyor screws 29. These extend axially through the separation chamber 20 close to the surrounding wall 17 and are evenly distributed around the rotor shaft 15. Each conveyor screw 29 is journalled at its ends in the respective end walls 13, 14 and is rotatable around its centre axis relative to the rotor walls during the rotation of the rotor around its rotational axis 4.

For the rotation of the conveyor screws 29 relative to the rotor the rotor shaft 15 supports immediately below the lower end wall 13 the above said annular member 9. This member 9 surrounds the rotor shaft 15 and is adapted by means of the motor 3 through the driving belt 10 to be rotated around the rotational axis 4 of the rotor at a speed different than that of the rotor. The annular member 9 has on its outside axially above the driving belt 10 a gear ring 30 engaging several bearing members 31 evenly distributed around the rotor shaft 15. Each bearing member 31 is connected with a conveyor screw 29 and forms part of a slide bearing through which the conveyor screw 29 is journalled in the lower end wall 13. The bearing member 31 and its co-operation with the gear ring 30, the end wall 13 and the conveyor screw 29 is described more in detail below with reference to FIG. 3.

Figure 2:
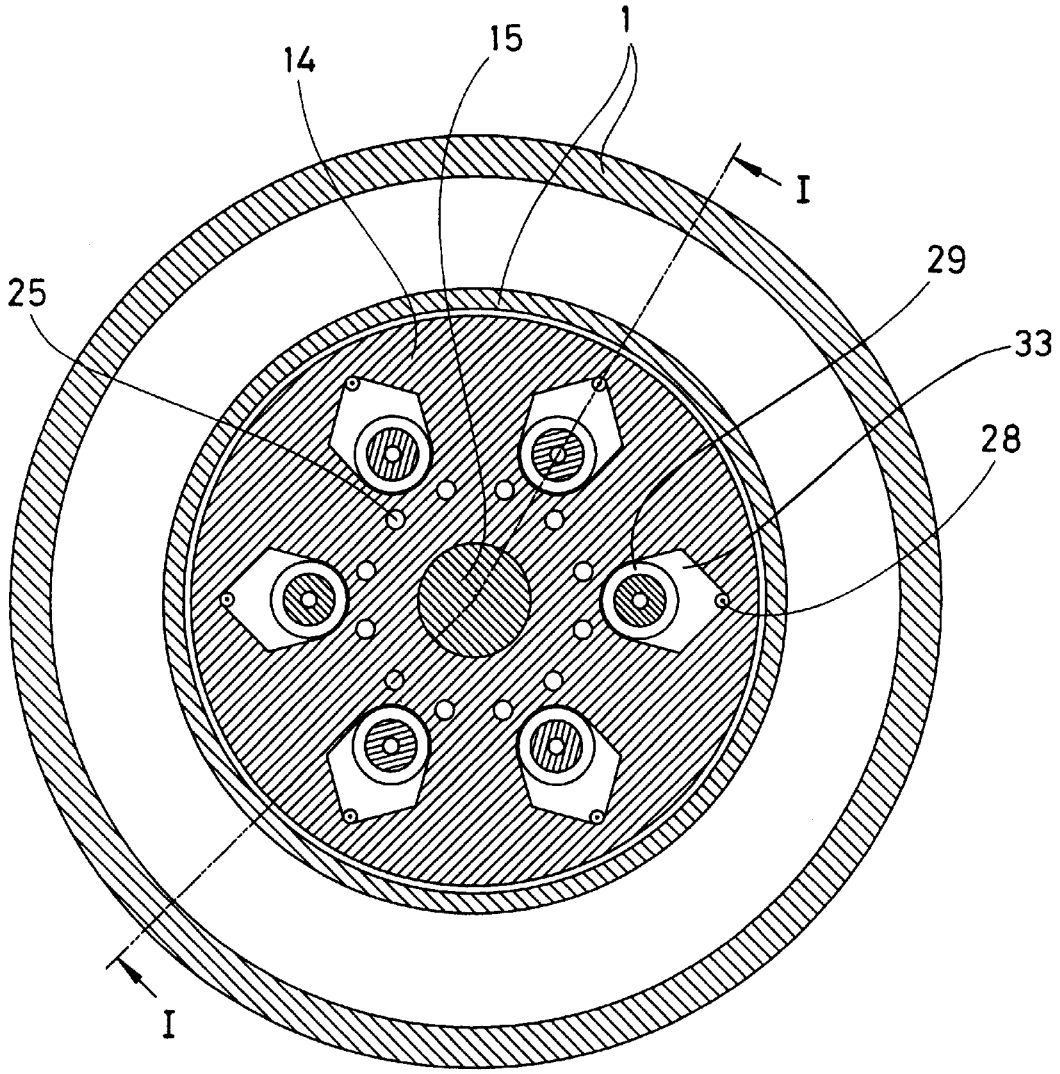
FIG. 2 shows a section along the line II—II in FIG. 1.

At its upper end each conveyor screw 29 is journalled in the upper end wall 14 by means of a pin 32. Radially outside the uppermost end portion of each conveyor screw 29 and axially in the area of the uppermost separation disc 21 there is delimited in the separation chamber 20 by the upper end wall 14 a space or a pocket 33 which extends radially outwardly from said end portion of the conveyor screw to a level radially outside the inside of the surrounding wall 17. At the radially outermost part of each such pocket one of the afore-mentioned outlet channels 28 is situated. FIG. 2 shows a section through the upper end wall 14, taken along the line II—II in FIG. 1. Between adjacent pockets 33 parts of the end wall 14 form filler pieces which prevent communication between the sludge pockets in the circumferential direction of the rotor.

For closing and intermittent uncovering of the outlet channels 28 the rotor is provided with an axially movable slide 34. By means of springs 35 arranged between the inlet member 22 and the slide 34 the slide 34 is kept pressed against the outside of the upper end wall 14, axial protuberances of the slide 34 abutting sealingly against the end wall around the openings of the respective outlet channels 28.

Between the slide 34 and the end wall 14 there is delimited radially inside the outlet channels 28 a so called opening chamber 36, which via channels through the inlet member 22 and the rotor shaft 15 communicates with the interior of a narrow tube 37 extending axially upwardly through and out of the inlet member 22 to an upper pressure source of air (not shown). Through supply of pressurised air to said opening chamber 36 the slide 34 during rotation of the rotor may be caused to move axially upwardly against the action of springs 35, so that the outlet channels 28 are uncovered.

Figure 3:
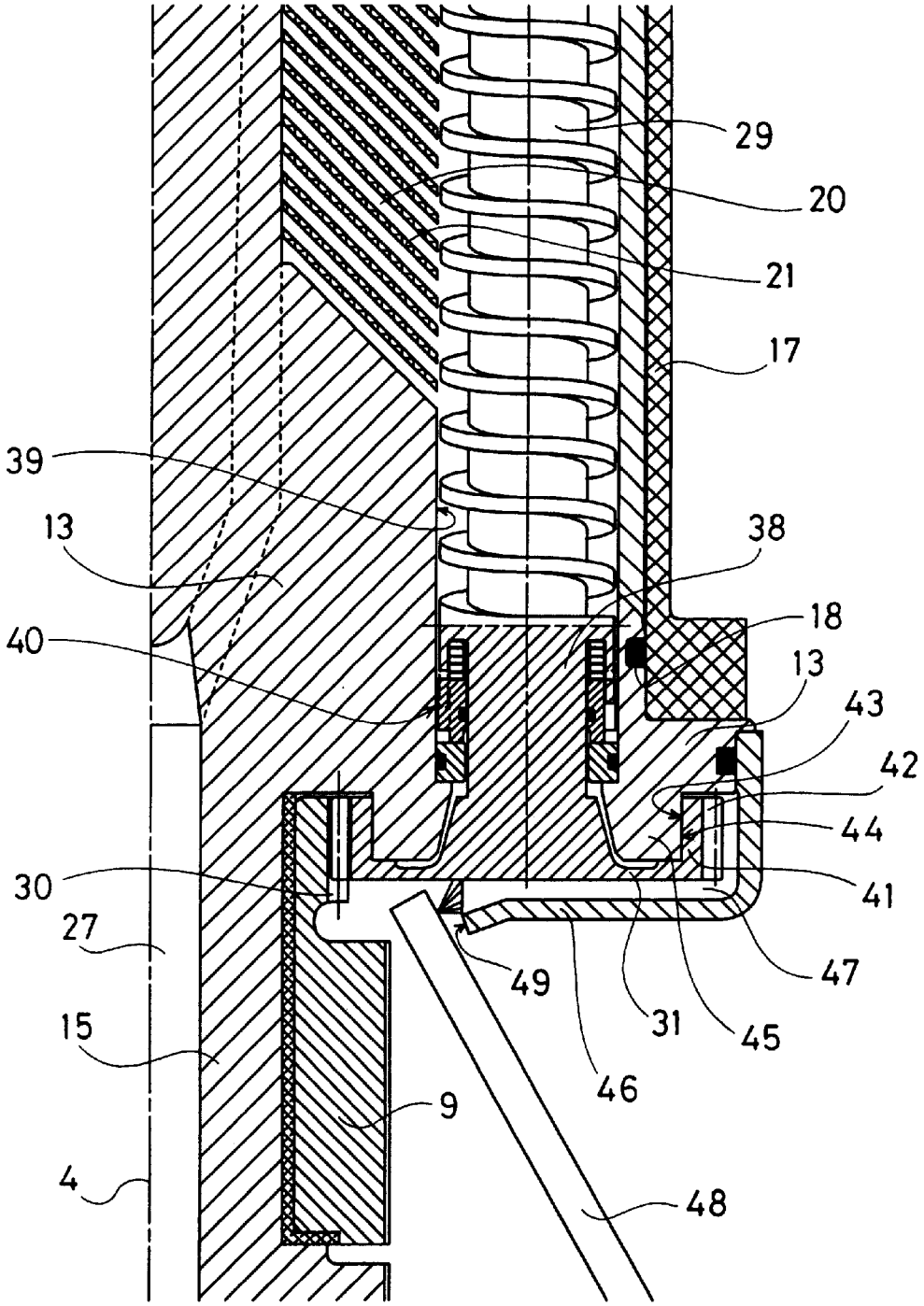
FIG. 3 shows an enlarged part of FIG. 1.

FIG. 3 shows in an enlarged scale part of FIG. 1. It can thus be seen from FIG. 3 that the bearing member 31 is supported by a transmission shaft in the form of a short tap 38 extending within a bore 39 in the end wall 13 and connected with the conveyor screw 29. The bearing member 31 with its tap 38 as well as the conveyor screw 29 may be made of plastic. A sealing device 40 is arranged in the bore 39 and is adapted to seal, between the tap 38 and the end wall 13.

The bearing member 31 has a tubular surrounding part 41, which on its outside is provided with cogs 42 and on its inside has a slide bearing surface 43. The cogs 42 engage the gear ring 30 of the annular member 9. and the slide bearing surface 43 co-operates with a corresponding slide bearing surface 44 formed on an annular protuberance 45 on the outside of the end wall 13. The protuberance 45 which may have a surface layer of a ceramic material provided with said slide bearing surface 44 surrounds the opening of the bore 39 in the end wall 13, and the two co-operating slide bearing surfaces 43, 44 thus have a substantially larger circumference than the bore 39.

On the outside of the rotor end wall 13 there is mounted an annular further wall 46. This confines between itself and the outside of the end wall 13 an annular transmission chamber 47, which is closed radially outwardly but open radially inwardly towards the rotor shaft 15. The chamber 47 during operation of the rotor may be filled with liquid, e.g. water, trough a supply pipe 48 and is intended always to be filled during operation of the rotor. A radially inner edge 49 of the further wall 46 may serve as an overflow outlet for liquid being supplied to the chamber 47.

As can be seen from FIG. 3, a substantial part of the bearing member 31 will be present during operation of the rotor in liquid present in the chamber 47. This liquid has two purposes; firstly, it shall operate as a lubricator between the slide bearing surfaces 43 and 44, when the conveyor screw 29 rotates relative to the rotor, and secondly it shall create an hydraulic force to which the bearing member is subjected during its rotation around the rotational axis 4 of the rotor and, thereby, acts unloading on the slide bearing formed by the bearing member 31 and the protuberance 45 on the rotor end wall 13.

Figure 4:
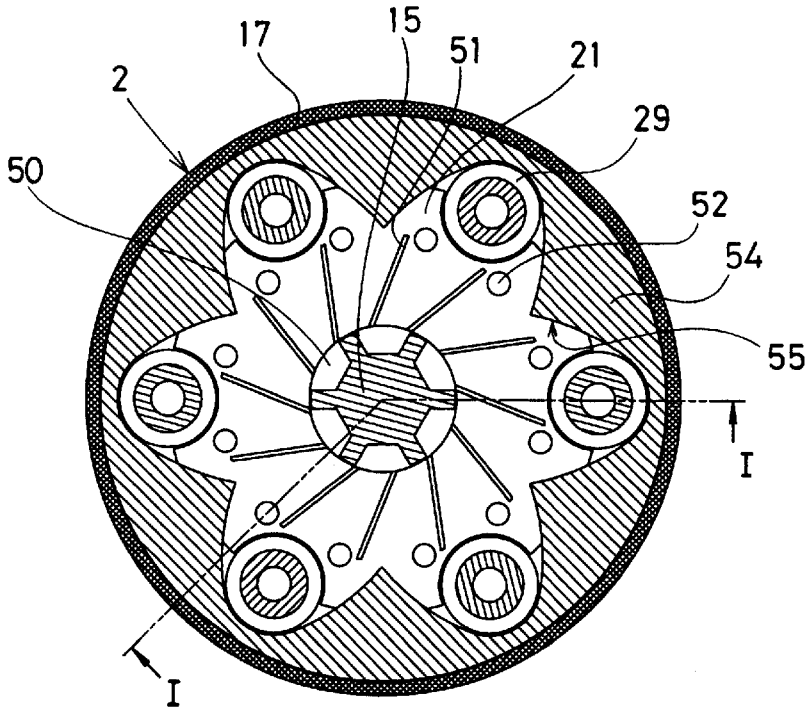
FIG. 4 shows a cross-section through the centrifugal rotor shown in FIG. 1 taken between two adjacent separation discs.
Figure 5:
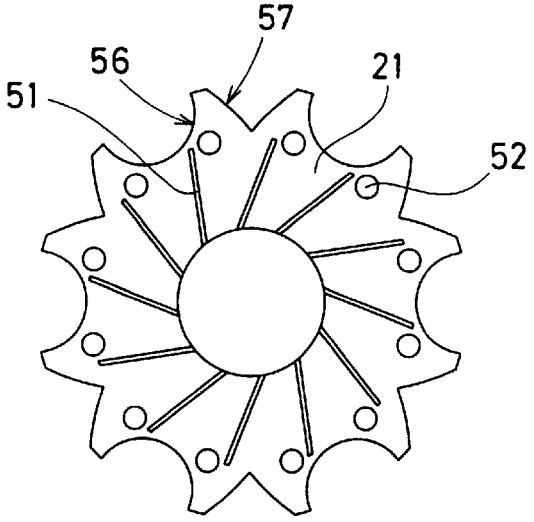
FIG. 5 shows a separation disc of the kind shown in FIG. 4.

FIG. 4 shows a cross section through the rotor 2 in FIG. 1. The section is taken between two adjacent conical separation discs 21. FIG. 5 shows a single separation disc 21 of the kind also shown in FIG. 4.

From FIG. 4 it can be seen further that the centre shaft 15 of the rotor has axial grooves 50 forming axial flow paths radially inside the separation discs 21 for liquid which has been freed from solid particles in the separation chamber 20. The separation discs 21 are supported radially in all directions by the shaft 15. FIG. 4 also shows that the separation discs 21 are provided with several conventional spacing members 51 which are evenly distributed around the shaft 15 and keeps the separation discs at a desired distance from each other.

The separation discs 21 have several through-holes 52, each being placed between two adjacent spacing members 51, the holes being axially aligned with corresponding holes in the other separation discs 21. The holes 52 form axial so called distribution channels 53 (FIG. 1) through the stack of separation discs axially aligned with the openings of the previously mentioned branch channels 25 in the upper rotor end wall 14.

A filler piece 54 extends inside the surrounding wall 17 around the stack of separation discs 21 and the conveyor screws 29. This filler piece has recesses for the conveyor screws 29 and extends in the areas between the conveyor screws radially inwardly forming axially extending ridges which have contact with the separation discs 21. The separation discs which are relatively thin and may be made of plastic receive during operation of the rotor, therefore, radial support from the said ridges of the filler piece 54. Between the conveyor screws the filler piece is so formed that solid particles which during operation of the rotor are separated from the liquid and move radially outwardly between the separation discs will slide on the hills 55 of said ridges in a direction towards the conveyor screws and in between their threads.

FIG. 5 shows that each separation disc has both recesses 56 for the conveyor screws 29 and recesses 57 for the filler piece 54.

Figure 6:
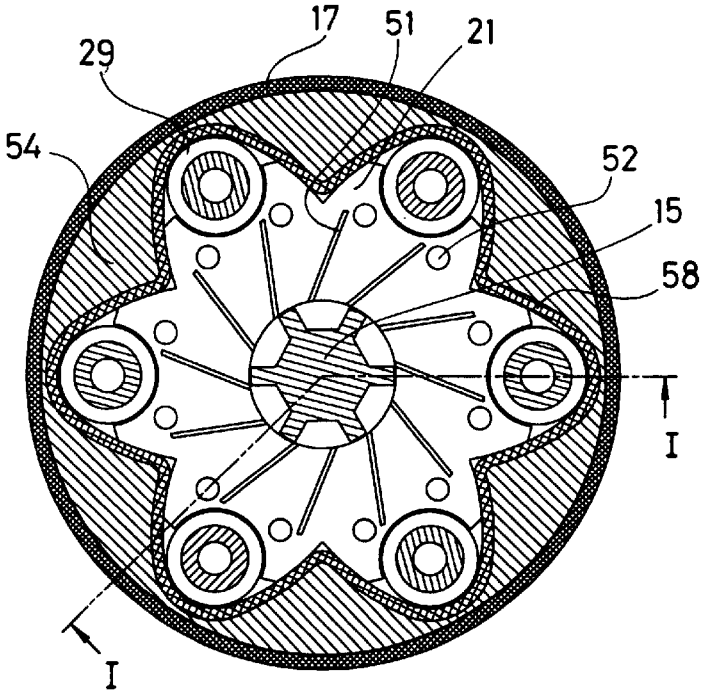
FIG. 6 shows a cross-section, similar to that in FIG. 4, of a somewhat modified embodiment of the invention.

The filler piece 54 may be formed in one piece, suitably from plastic or some other relatively light material. Alternatively, it may be composed of several annular elements having the cross-sectional form shown by the filler piece 54 in FIG. 4, or from several straight axially extending elements, which are evenly distributed around the rotational axis of the rotor. For covering of the interspaces which may remain between annular or straight elements of this kind a lining 58 of plastic or other material, as shown in FIG. 6, may be arranged on the inside of the filler piece 54.

A further alternative for the forming of the filler piece 54 is that the conical separation discs are formed so that they form together said filler piece. This alternative is illustrated in the FIGS. 7–9.

Figure 7:
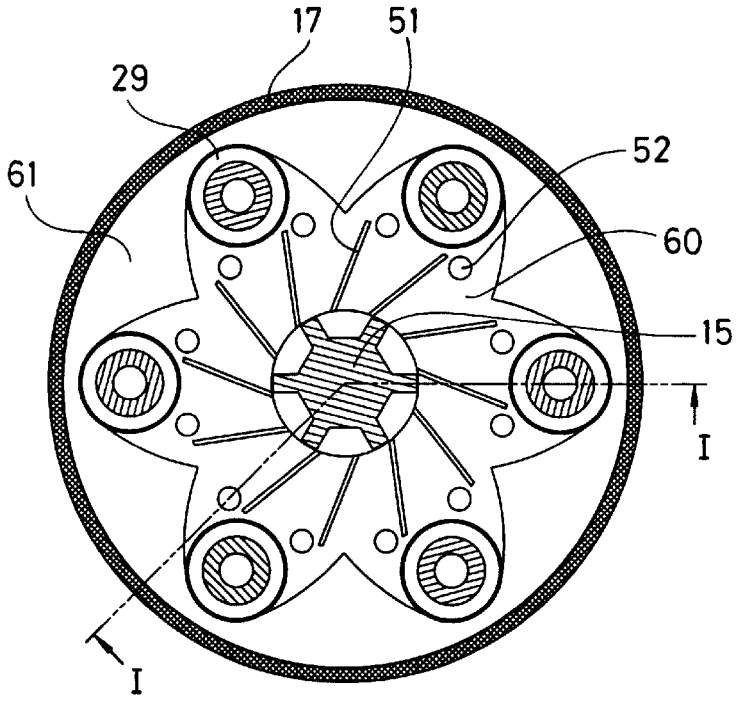
FIG. 7 shows a cross-section, similar to that in FIG. 4, of a further modified embodiment of the invention.
Figure 8:
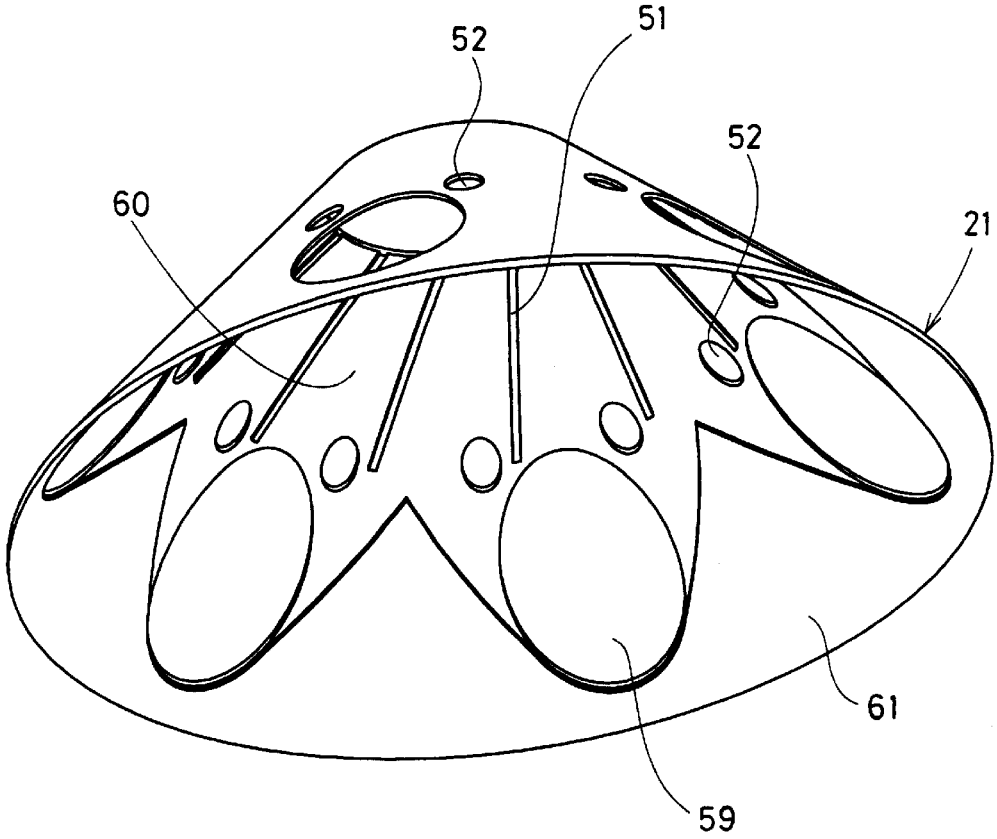
FIG. 8 shows a separation disc of the kind included in the modified embodiment of the invention according to FIG. 7.
Figure 9:
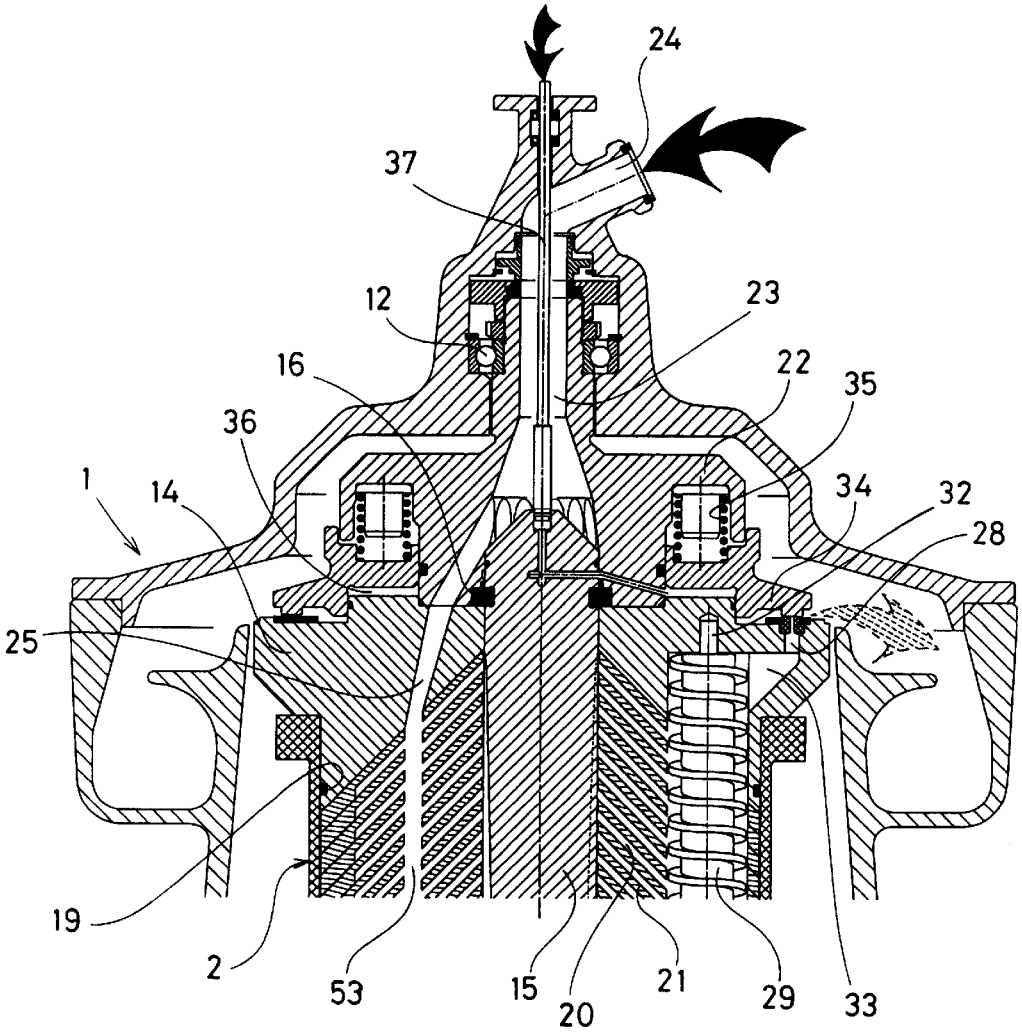
FIG. 9 shows in a longitudinal section part of a centrifugal separator having separation discs of the kind shown in the FIGS. 7 and 8.

As can be seen from the FIGS. 7 and 8 a separation disc 21 in this case has an entirely circular circumference and extends into contact with the surrounding wall 17 of the rotor around the whole of its circumference. The separation disc has through-holes 59 intended for the conveyor screws 29.

Like the separation disc shown in FIG. 5 the separation disc in FIG. 8 has spacing members 51 formed on its underside. In case these spacing members 51 are formed in one piece with the separation disc 21, this has a certain thickness in the areas of the spacing members 51 and a smaller thickness in the areas 60 situated between the spacing members 51. In the areas 60 there is thus created, when two separation discs abut against each other in a stack, a space in which liquid may flow between the separation discs.

The thickness that the separation disc in FIG. 8 has at the spacing members 51 it also has in a continuous area 61 extending along the whole of the circumference of the separation disc radially outside the holes 59 and between adjacent such holes 59 a distance radially inwardly towards the rotor shaft 15.

In a stack of separation discs formed as shown in FIG. 8 the separation discs will abut against each other in the areas 61 (see FIG. 9) and they will thus form in these areas a filler piece similar to the filler piece 54 in FIG. 4.

Common to the different embodiments of the filler piece 54 is that this is created around the whole of the rotor radially inside the circular-cylindrical surrounding wall 17, which is formed to take up large forces in the circumferential direction of the rotor. It is thus important that the surrounding wall of the rotor has a circular-cylindrical strong portion that surrounds the separation chamber 20 and the sludge conveyor screws 29.

The centrifugal separator described above with reference to the FIGS. 1–9 operates briefly in the following manner.

After the rotor 2 has been caused to rotate around its rotational axis 4 and the conveyor screws 29 simultaneously have been caused to rotate around their respective rotational axes relative to the rotor 2, a suspension of liquid and particles dispersed therein and having a density larger than that of the liquid is supplied through the inlet 24. The suspension is conducted through the channels 23 and 25 to the distribution channels 53 in the stack of separation discs 21. From respective holes 52 in the separation discs 21 the suspension flows out into the spaces between the separation discs 21 and is conducted between adjacent spacing members 51 to the axial channels 50 at the rotor shaft 15 (see FIG. 4).

On the way between the holes 52 and the channels 50 said particles are separated from the liquid and they slide along the underside of the separation discs back radially outwardly towards the conveyor screws 29. The inclined surfaces 55 on the filler piece 54 (see FIG. 4) makes the particles collecting exactly in the areas of the conveyor screws 29.

In the areas of the conveyor screws 29 the particles form a sludge which by the conveyor screws is transported axially within the separation chamber 20 towards the upper rotor end wall 14.

In the end wall 14 each conveyor screw 29 extends through a short cylindrical bore which opens into a pocket 33 (see FIGS. 1 and 2). The sludge formed in the separation chamber 20 is thus transported through these bores and out into the pockets 33. From here the sludge is discharged intermittently through the outlet channels 28 in that these are uncovered by means of the slide 34 at desired time intervals. The slide can be actuated by supply of pressurised air to the opening chamber 36. When sludge is supplied through said bore to a pocket 33, displaced liquid is conducted away from the pocket 33 to the separation chamber 20 in the part of the bore that is situated closest to the centre axis 4 of the rotor, where a narrow slot is formed between the threads of the conveyor screw 29 and the wall of the bore. The liquid having been freed from particles is conducted out of the rotor below the lower end wall 13 through the channels 26 and 27.

The slide 34 alternatively may be adapted automatically to uncover the outlet channels 28, when a predetermined resistance against turning of the conveyor screws 29 is obtained, indicating that a certain amount of sludge has been collected in the separation chamber.

Since the inlet for suspension is arranged at one end and the outlet for liquid at the opposite end of the separation chamber 20, and the outlet for sludge is arranged at the inlet end of the separation chamber, good prerequisites are obtained for liquid leaving the separation chamber to be substantially free from particles.

In the embodiments of the invention having been described above and shown in the drawings the conical separation discs are arranged in a way such that they face with their apex ends upwardly. If desired, they may instead be arranged with their apex ends facing downwardly towards the outlet for cleaned liquid. Then, the end walls 13 and 14 are suitably formed in a corresponding way, the lower end wall 13 then forming an upwardly open funnel which with its apex portion forms the central outlet for cleaned liquid. If the lower end wall 13 is formed in this way a complete emptying of the separation chamber 20 is facilitated after a finished separating operation.

During the separating operation axially directed pressures against both the end walls 13 and 14 of the rotor come up as a consequence of the centrifugal force to which the liquid and the particles in the separation chamber are subjected. The whole of this force is taken up by the rotor shaft 15 which is fixed relative to both of the end walls 13 and 14.

Figure 10:
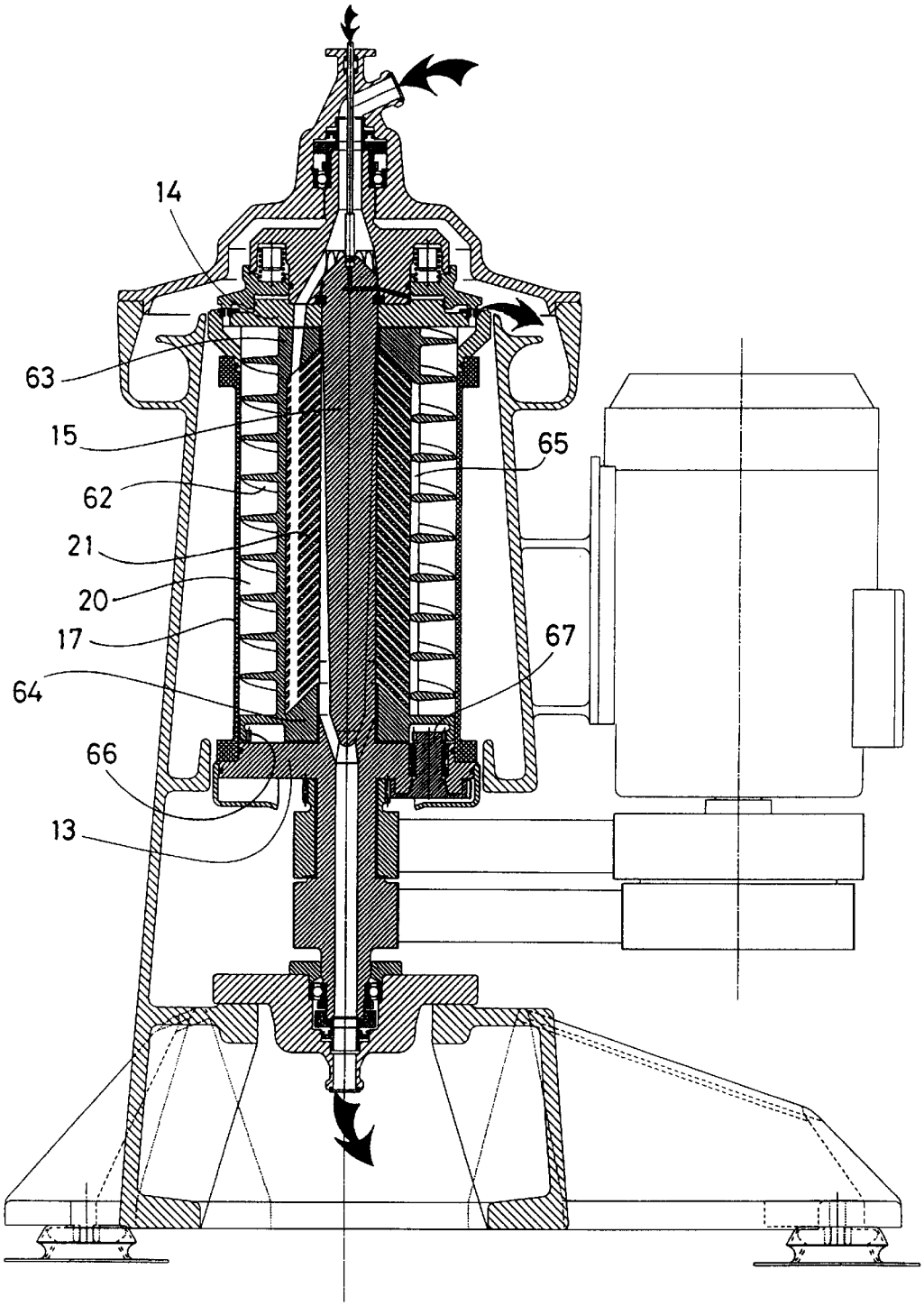
FIG. 10 shows in a longitudinal section a centrifugal separator according to a further embodiment of the invention.
Figure 11:
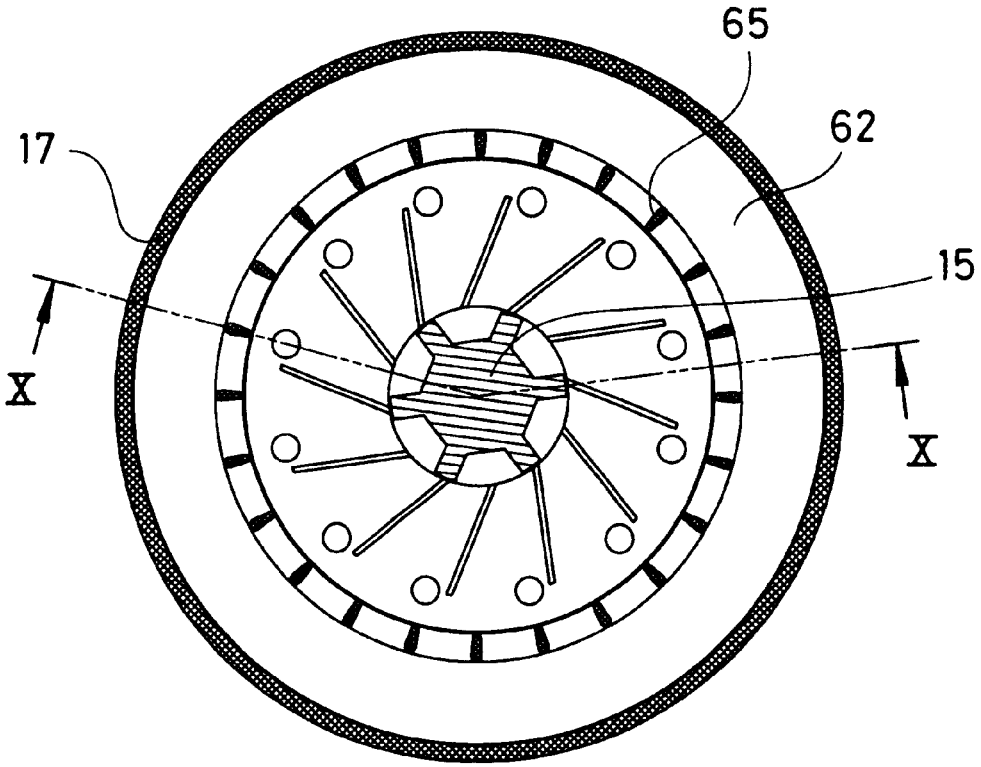
FIG. 11 shows a cross-section through the centrifugal rotor shown in FIG. 10.

The FIGS. 10 and 11 illustrate an alternative embodiment of a centrifugal separator according to the invention. In the following only the most important differences between this embodiment and the previously described embodiments will be mentioned. The same reference numerals have been used in the FIGS. 10 and 11 as in the other figures for details which substantially correspond to each other.

The centrifugal separator in the FIGS. 10 and 11 has only one single conveyor screw 62 and this extends helically around the rotor shaft 15 through the separation chamber 20.

At its ends the conveyor screw 62 is journalled by means of bearing members 63 and 64 directly on the rotor shaft 15. The bearing members 63 and 64 are firmly connected with each other by means of axial rib-formed elements 65 extending axially through the separation chamber 20 at the outer edges of the separation discs 21. The elements 65 during the rotation of the rotor may give radial support to the separation discs 21 if these are formed for instance of plastic and have a tendency of expanding radially. It is also simultaneously the elements 65 which are supporting the very conveyor screw 62.

The lower bearing member 64 has a tubular surrounding part carrying a gear ring 66 on its inside. This gear ring 66 is in engagement with a number of gear wheels evenly distributed around the rotor shaft 15 and supported by short taps 67 each of which corresponds to the tap 38 in FIG. 3. The taps 67 thus extend through the rotor end wall 13 and are journalled on its outside by means of bearing members like the bearing members 31 in FIGS. 1 and 3. By rotation of the taps 67 in the same way as has earlier been described with reference to the taps 38 the bearing member 64 and, thereby, the conveyor screw 62 may be rotated relative to the rotor shaft 15.

The centrifugal separator according to the FIGS. 10 and 11 operates for the rest principally in the same manner as the centrifugal separator according to FIG. 1.

What is claimed is:

1. A centrifugal separator for freeing a liquid from particles suspended therein and having a density larger than that of the liquid, comprising rotor which has a centre axis, around which it is rotatable, and that comprises two axially separated end walls and a surrounding wall situated therebetween, said walls surrounding a separation chamber, at least one conveyor screw device, which is arranged in the separation chamber and rotatable relative to the rotor for axial transportation of separated solid particles along the surrounding wall, two or more transmission shafts for operation of the conveyor screw device, which extend from the separation chamber through respective openings in one of said end walls and are rotatable around rotational axes substantially parallel with the centre axis of the rotor, and bearings for radial journalling of the transmission shafts (38;67) in the rotor, wherein the rotor (2) delimits a transmission chamber (47) that is liquid tightly separated from the separation chamber (20), and the rotor is formed to maintain in the transmission chamber during rotation of the rotor an auxiliary liquid in contact with at least part of each one of said bearings.

2. A centrifugal separator according to claim 1, in which said bearing is constituted by a slide bearing.

3. A centrifugal separator according to claim 1, in which the transmission chamber is delimited between said one end wall and a further wall, which extends around the centre axis of the rotor.

4. A centrifugal separator according to claim 1, in which the transmission chamber has an overflow outlet for said auxiliary liquid.

5. A centrifugal separator according to claim 1, in which each of the transmission shafts supports a bearing member in the transmission chamber, which has a bearing surface extending around a respective transmission shaft along a circle having a substantially larger diameter than the diameter of said opening in one of said end walls through which the respective transmission shaft extends.

6. A centrifugal separator according to claim 5, in which each of the transmission shaft is journalled through its bearing member in one of said end walls.

7. A centrifugal separator according to claim 6, in which each bearing member has a surrounding part, which is formed with said bearing surface facing the transmission shaft.

8. A centrifugal separator according to claim 7, in which said surrounding part of each bearing member is arranged in a driving engagement, directly or indirectly, with a central transmission member for driving of the transmission shafts.

9. A centrifugal separator according to claim 8, in which said surrounding part is arranged in a driving engagement with the central transmission member in an axial plane that substantially coincides with an axial plane through the bearing surface of the surrounding part.

10. A centrifugal separator according to claim 8, in which each bearing member is formed as a cog wheel.

11. A centrifugal separator according to claim 5, in which the transmission chamber is formed so that the bearing member on each of transmission shafts will be at least partly immersed in said auxiliary liquid during rotation of the rotor, so that it will be influenced during operation by a hydraulic force directed towards the rotational axis (4) of the rotor.

12. A centrifugal separator according to claim 1, in which said bearings are arranged between the transmission shafts, and sealing members are arranged around the respective transmission shafts between said bearings and the separation chamber.

13. A centrifugal separator according to claim 1, in which said at least one conveyor screw device comprises two or more conveyor screws distributed around the rotational axis of the rotor and extending substantially in parallel therewith, each one of the conveyor screws being connected with one of said transmission shafts.

14. A centrifugal separator according to any one of claims 1–12, in which said at least one conveyor screw device comprises a conveyor screw which extends helically around the centre axis of the rotor and which in the separation chamber supports a transmission member arranged to be in driving engagement with said transmission shafts for rotation of the conveyor screw relative to the rotor around the centre axis thereof.

* * * * *

UNITED STATES PATENT AND TRADEMARK OFFICE

CERTIFICATE OF CORRECTION

PATENT NO. : 6,217,502 B1
DATED : April 17, 2001
INVENTOR(S) : Hans Martin, Ingvar Hallgren and Berndt Nystrom It is certified that error appears in the above-identified patent and that said Letters Patent is hereby corrected as shown below:

Title page,
Change the reference to the PCT filing date from "Mar. 26, 1999" to -- Mar. 26, 1998 -- .

Column 1,
Line 43, insert the heading -- Summary of the Invention -- .

Column 5,
Line 25, after "hydraulic force" insert -- acting on the bearing member 31 in a direction towards the rotational axis 4 of the rotor. The hydraulic force counteracts the centrifugal force -- .

Column 8,
Line 47, delete "(38;67)".
Line 49, delete "(2)" and "(47)".
Line 51, delete "(20)".

Column 9,
Line 5, change "shaft" to -- shafts -- .
Line 24, insert -- the -- after "of".

Column 10,
Lines 15-16, change "any one of claims 1-12" to -- claim 1 --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*